US007231745B1

(12) United States Patent
Shoji

(10) Patent No.: US 7,231,745 B1
(45) Date of Patent: Jun. 19, 2007

(54) TRUSS STRUCTURE, STRUCTURAL MEMBERS THEREOF, AND A METHOD OF MANUFACTURE THEREFOR

(76) Inventor: Bunichi Shoji, 1245-48, Kasahara-machi, Mito-shi, Ibaraki 310-0852 (JP)

( * ) Notice: Subject to any disclaimer, the term of this patent is extended or adjusted under 35 U.S.C. 154(b) by 0 days.

(21) Appl. No.: 09/245,720

(22) Filed: Feb. 8, 1999

(30) Foreign Application Priority Data

May 9, 1997 (JP) ..... 9-119053

(51) Int. Cl.
*E04C 3/02* (2006.01)
*E04C 3/30* (2006.01)

(52) U.S. Cl. ..... 52/691; 52/697; 52/693; 52/690

(58) Field of Classification Search ..... 52/690–694, 52/696–697, 653.2, 656.9, 81.1, 81.3; 403/292, 403/306, 379, 109, 354, 378; 29/897.31; 411/166, 167, 338, 339, 427
See application file for complete search history.

(56) References Cited

U.S. PATENT DOCUMENTS 774,159 A * 11/1904 Cook ..... 29/897.31
1,828,235 A * 10/1931 Hattum ..... 29/897.31
1,908,757 A * 5/1933 Hathorn ..... 29/897.31
2,129,466 A * 9/1938 Ferguson ..... 52/653.2
3,496,693 A * 2/1970 Troutner ..... 29/897.31
3,925,942 A * 12/1975 Hemmelsbach ..... 52/86
4,050,210 A * 9/1977 Gilb
4,187,034 A * 2/1980 Dziewolski ..... 403/217
4,211,044 A * 7/1980 Gugliotta et al. ..... 52/200
4,604,844 A * 8/1986 Mikulas
4,704,836 A * 11/1987 Codd ..... 52/653.2
5,078,534 A * 1/1992 White
5,802,798 A * 9/1998 Martens ..... 52/653.1
5,927,138 A * 7/1999 Richardson ..... 29/897.31
6,131,362 A * 10/2000 Buecker ..... 52/729.5
6,176,060 B1 * 1/2001 Kenelly

FOREIGN PATENT DOCUMENTS

JP 60-89744 5/1985
JP 61-100704 5/1986
JP 5-311765 11/1993
JP 7-180217 7/1995

* cited by examiner

*Primary Examiner*—Naoko Slack
*Assistant Examiner*—Chi Q. Nguyen
(74) *Attorney, Agent, or Firm*—Crowell & Moring LLP

(57) ABSTRACT

A joint having an improved rigidity realized by a shortened inter-joint distance and suitable for use in a truss structure is provided. A connection part is formed on the end of a pipe member to be used as a chord member. The connection part of the pipe for connecting with a parent plate for assembly of the truss structure is comprised of a tubular section formed by constrained pattern pressing of the pipe, and a flat section which is formed integral with and in close proximity to the tubular section.

4 Claims, 6 Drawing Sheets

(a)

(b)

TRUSS STRUCTURE, STRUCTURAL MEMBERS THEREOF, AND A METHOD OF MANUFACTURE THEREFOR

BACKGROUND OF THE INVENTION

The present invention relates to a truss structure for use in a roofing and the like of a building.

As a space truss structure which can shorten the term for completion of work by facilitating the connection of its chord members, a conventional truss structure is disclosed in JPA Laid-Open No. 60-89744. A connection member is provided on one surface of which a connection tube for connecting chord members is erected, and on the other surface of which a rib for connecting diagonal chord members is mounted, whereby chord members each having a connecting part on the end thereof are connected thereto via washers which may be in any numbers. Further, JPA Laid-Open No. 5-311765 discloses a flat metal square column pipe member having a concave cross-section fitting member on both ends thereof formed by press or roll working, and wherein the concave cross-section fitting part is provided with a long narrow opening for fitting which is pierced therethrough. Still further, a double pipe type truss beam which integrates an upper chord member and a lower chord member formed of a pipe, and a web member is disclosed in JPA Laid-Open No. 7-180217. Still further, JPA Laid-Open No. 61-100704 discloses a connection structure for a truss joint which is comprised of joining diagonal pipe members via a cross gausset plate to an M-shaped, H-shaped chord members or to a vertical pipe member, wherein a backup member outside the truss plane of the gausset plate is omitted such that the bore of the pipe between a flange and a web of the chord member is effectively utilized.

As mentioned above, various efforts have been made in order to facilitate the connection of the chord members and shorten the term for completion of work. Also, it is known to flatten the connection edge of the chord member by compression pressing to this effect. In this conventional structure, however, existence of a free plastic deformation part, which is elliptic and extends between the flat surface provided by compression pressing and the complete round section of a parent pipe member cannot be avoided. This long and narrow free plastic deformation part adjoining the connection end structure flattened by compression according to the conventional method is not only unnecessary but also disadvantageous in the truss structure because the size of the parent plate for connecting the chord member using a bolt thereto becomes inevitably large. Provision of such a large sized parent plate has been a cause to increase the size of its joint structure, thereby decreasing its rigidity, and increasing the cost of manufacture.

SUMMARY OF THE INVENTION

An object of the present invention is to provide for a truss structure which can improve its rigidity by reducing the size of its joint structure, and lower the cost of manufacture by reducing the size of its parent member plate.

Another object of the invention is to provide for structural members suitable for use in constructing this truss structure, and a method of manufacture thereof.

One of the features of the present invention resides in an edge portion of a pipe being forcibly pressed between an upper die and a lower die, each having a same cylindrical surface of constraint. By use of such dies, it becomes possible to directly form a flat surface section on the edge of a pipe member while securing a complete round portion thereof serving as a parent member. Therefore, the long free plastic deformation part which is inevitably formed using the conventional dies having a flat surface portion for forming a conventional flat structure can be eliminated, and a connection edge having a flat surface which is directly connected to the complete round parent member can be realized according to the invention. The present invention, as stated above, is characterized by the forced constrained pattern pressing of the edge portion of the pipe using the upper and the lower dies having a cylindrical semi-surface of constraint. However, it is not limited thereto, and a modification of which for providing a polygonal or a short elliptical structures instead of the cylindrical is within the scope of the invention. Essentially, in forming the flat section, it is intended to form a constrained tubular portion between the flat section and the complete round parent member by a constrained pattern forming press, and the shape of this constrained tubular portion may be the same as the pipe as the complete round parent material or any shape required in its design.

More specifically, the truss structure, structural members therefor and the method of manufacture thereof as will be described below are provided according to the invention.

The present invention provides for the truss structure for connecting an upper chord member, lower chord member and diagonal chord member to its parent plate via respective connection parts of each member provided on both ends thereof, wherein the upper chord member, the lower chord member and the diagonal chord member used is a pipe member, and wherein the connection part of the pipe member is comprised of a tubular portion forcibly shaped into the same diameter and the flat surface portion formed integral with the tubular portion by compression pressing, further wherein the connection part is connected to the parent plate via a bolt opening provided in the flat surface portion.

Preferably, the connection part member includes the parent plate and a rib member erected cross-wise thereon, and each edge portion of each flat surface part is tapered and arranged in juxtaposition.

The truss structure according to the invention has the upper chord member, the lower chord member and the diagonal chord member, each having the connection part on the both ends thereof for connecting to the parent plate therethrough. The upper, the lower and the diagonal chord members use a pipe member, and the connection part has a flat surface portion formed by the compression pressing, with the edge portion of the flat surface portion being tapered. Assuming a distance (2×1) between connection center positions of two flat portions of juxtaposed two chord members to be Ul" when divided by 2, and a diameter of a bolt opening provided in the flat surface portion to be "d", the following relationship between "1" and "d" exists.

$$l \leq \sqrt{2}t/2+10\sqrt{2}+2.0\ d+B/2, \text{ and } l>3\ d(\text{in mm}).$$

According to one aspect of the invention, the truss structural members include the upper chord, the lower chord and the diagonal chord members, each having a connection part on the both ends thereof. The connection part is comprised of the tubular portion forcibly formed into the constrained pattern with a constrained restriction, and the flat surface portion formed integral with the tubular portion by flat pressing, and the bolt opening is provided in the flat surface portion.

According to another aspect of the invention, the die is provided for forming the connection part on the edge portion of the truss structural members such as the upper chord, the lower chord and the diagonal chord members, which are tubular, wherein the die is comprised of an upper press die and a lower press die. Each die has a half tubular curved surface open to the outside and placed oppositely to provide for a constraint groove in combination whereby a constrained pattern is able to be formed.

According to still another aspect of the invention, the method for manufacturing the truss structural members such as the upper, the lower and the diagonal chord members which are provided with respective connection parts on both ends thereof comprises the steps of: placing a pipe between the upper and the lower press dies, each having the half tubular curved surface which is open to the external and positioned oppositely so as to provide for in combination one constrained shape; and simultaneously forming the flat surface portion connected integral with the tubular portion by pressing.

BRIEF DESCRIPTION OF THE DRAWINGS

Other features and advantages of the invention will be apparent from the following description taken in connection with the accompanying drawing wherein.

DETAILED DESCRIPTION OF THE DRAWINGS

Figure 1:
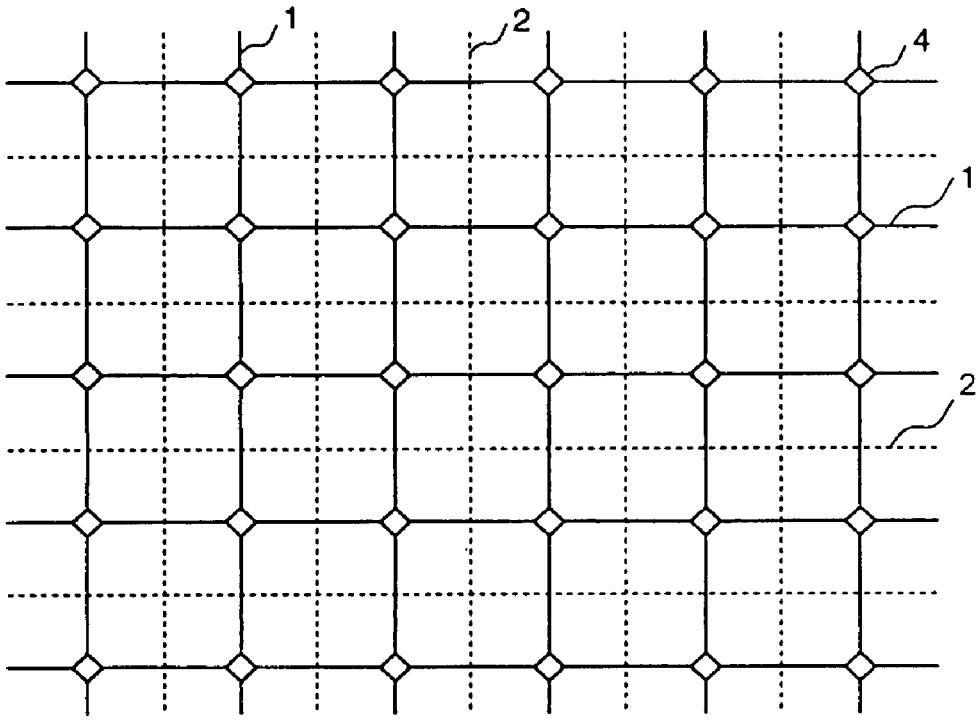
FIG. 1 is a schematic plan view of a truss structure embodying the invention.
Figure 2:
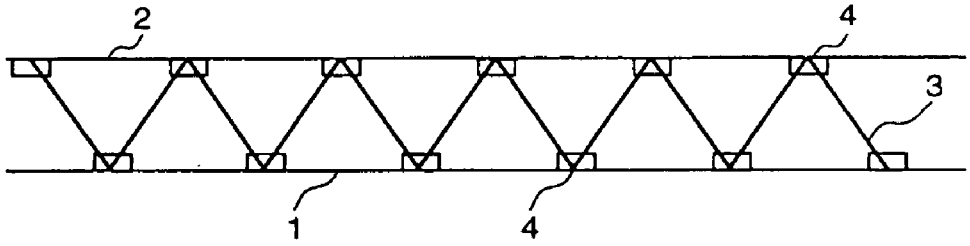
FIG. 2 is a cross-sectional view of FIG. 1.

With reference to FIGS. 1 and 2, a plan view and a cross-section of a truss structure according to the invention are shown. In these drawings, numeral 1 depicts a lower chord member, 2 depicts an upper chord member, 3 depicts a diagonal chord member, and 4 depicts a cross plate, respectively. This truss structure is formed by lower chord member 1, upper chord member 2 and diagonal chord member and has a rectangular cross-section extending in a span direction and a column direction. The lower chord member 1, the upper chord member 2 and the diagonal chord member 3 are jointed to the cross plate 4 with bolts for assembly. The cross plate 4 is formed by welding a plate for the chord member and a plate for the diagonal chord member crosswise.

Figure 3:
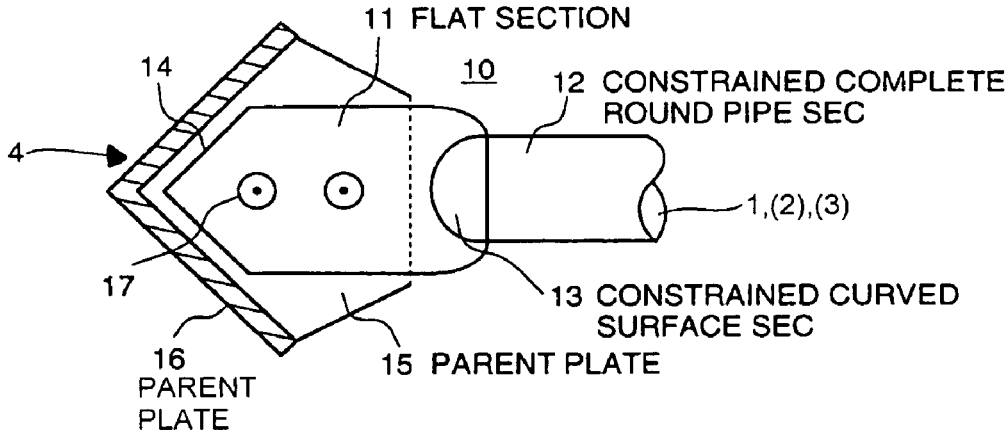
FIG. 3 is a plan view of a joint according to one embodiment of the invention.
Figure 4:
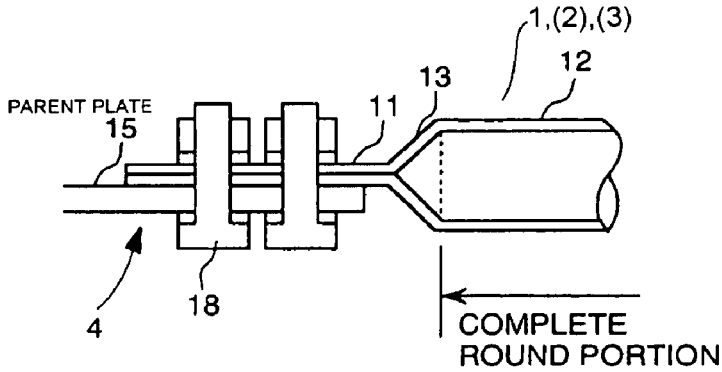
FIG. 4 is a cross-sectional side view of FIG. 3.

Now, with reference to FIGS. 3 and 4, a connection part lQ of the chord member is comprised of a flat surface section 11 and a constrained complete round pipe section 12. The constrained complete round pipe section 12 as will be described later is a constrained complete round portion formed by compression between the upper and the lower press dies, and has a structure directly connected to the flat surface portion 11. However, because there naturally exists a transitional deformation portion from the complete round portion to the flat surface portion, it should be understood that a curved surface portion 13 having a small radius of curvature must be formed therebetween. This curved surface is also constrain-formed and is a semi-circle. The leading edge of the flat surface portion is formed into a tapered shape 14. A plurality of bolt holes 17 are formed along a line connecting between the tapered leading edge portion and the center of the constrained complete round pipe portion 12 (two bolt holes are provided in the case of FIG. 3). The connection part 10 of the chord member has the flat surface portion 11 formed by the compression pressing as will be described more fully below, and bolt holes 17 are formed into this flat surface portion 11. The leading edge of the flat surface portion 11 is tapered into a pointed shape 14. This connection part 10 is firmly connected with bolts 18 to parent plates 15, 16 which are assembled cross-wisely by welding. The method of manufacture thereof will be described with reference to FIG. 5.

The die is comprised of the upper die press 21 and the lower die press 22, and in each die press, there are formed a flat surface press section 23, a semi-circular cylindrical surface press section 24 and a curved surface press section 25. A pipe chord member 1, 2, 3 is placed in the semi-circular cylindrical surface press section 24 between the upper and the lower die press 21, 22, and forcibly pressed. By so providing, a connection part 10 having the structure as shown in (c) of FIG. 5 can be obtained wherein the constrained complete round pipe portion 12 and the flat surface portion are directly connected via the curved surface portion 13. The edge portion of the connection part 10 may be prefabricated then pressed, or may be fabricated after presswork.

Figure 5:
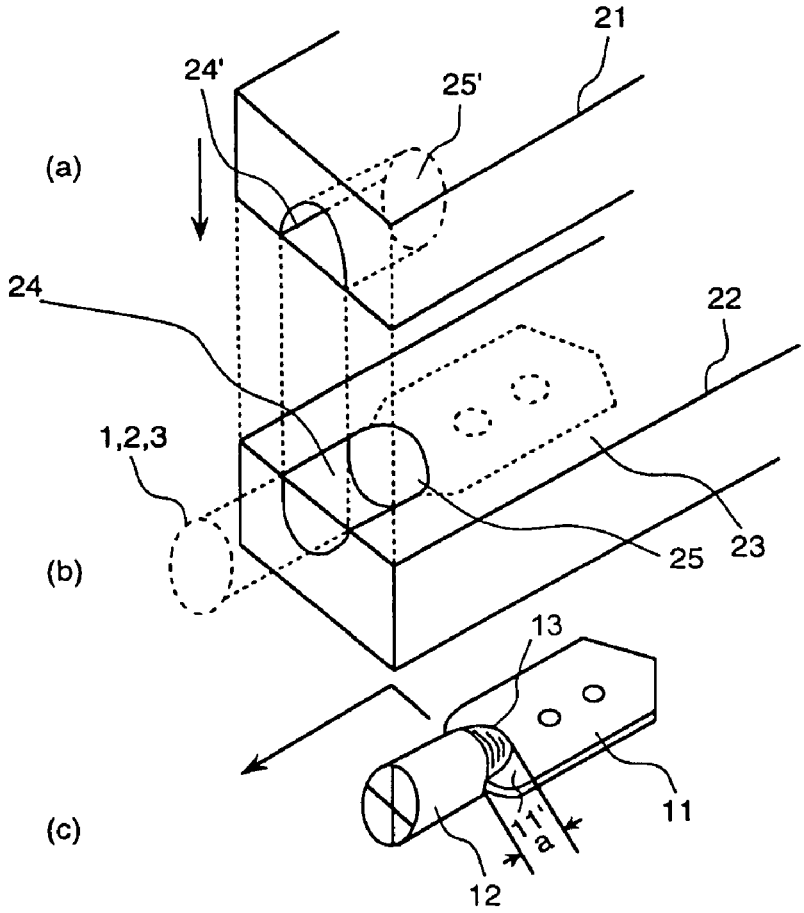
FIG. 5 is a perspective view illustrating how a method of manufacture according to the invention is implemented.

With reference to (c) of FIG. 5, there is formed a transitional slack portion 11" on the edge portion of the pipe 12 flattening from the complete round constrained tube. This flattening slack portion 11' having axial length "a" which extends from the pipe 12 to the flat surface part 11 has an important function to transmit a stress from the section 11 to the section 12. The conventional connection part of an elliptical shape formed using the conventional flat press does not have this portion 11' according to the invention.

An advantage realized by provision of the tapered leading edge at the connection part 10 will be described in the following FIGS. 6 (*a*) and (*b*) showing two examples of the invention, in which (a) indicates one without tapering, and (b) indicates one with a tapered leading edge. In the case of (b), an angle of its leading edge tapering corresponds to an angle of a parent plate 16 which is mounted crosswise. Here, let's assume that a diameter of a bolt is "d", and a distance between the center of the diameter of a forefront bolt and the center of joint of the crosswise parent plate is "L" in the case of (a), and "1" in the case of (b). Namely, "L" or "1" represents a half-length of a distance between counterposed joints. Further, symbol "B" & "t" represent, a width of a flattened pipe or chord member plate and a thickness of the parent plate for use of the diagonal chord members, respectively.

Figure 7:
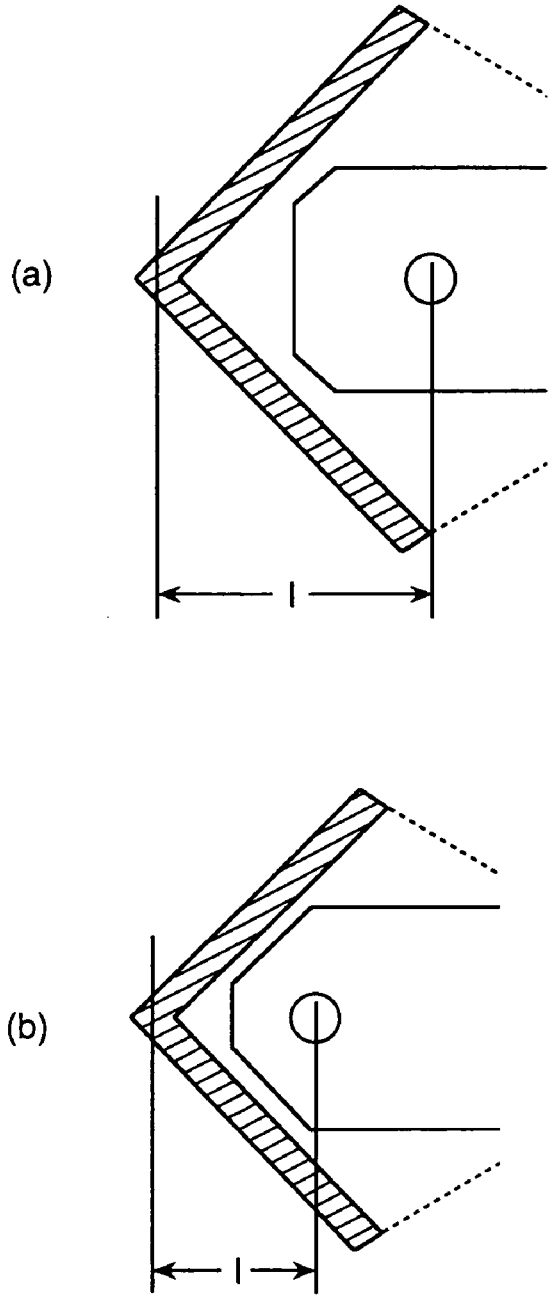
FIGS. 7(*a*) and (*b*) show still other embodiments of the invention.

FIGS. 7 (*a*) and (*b*) show other embodiments of tapered flat plate sections of the invention. FIG. 7(*a*) is an example having rounded corners, and FIG. 7 (*b*) is an example which is tapered into a sword edge.

Figure 8:
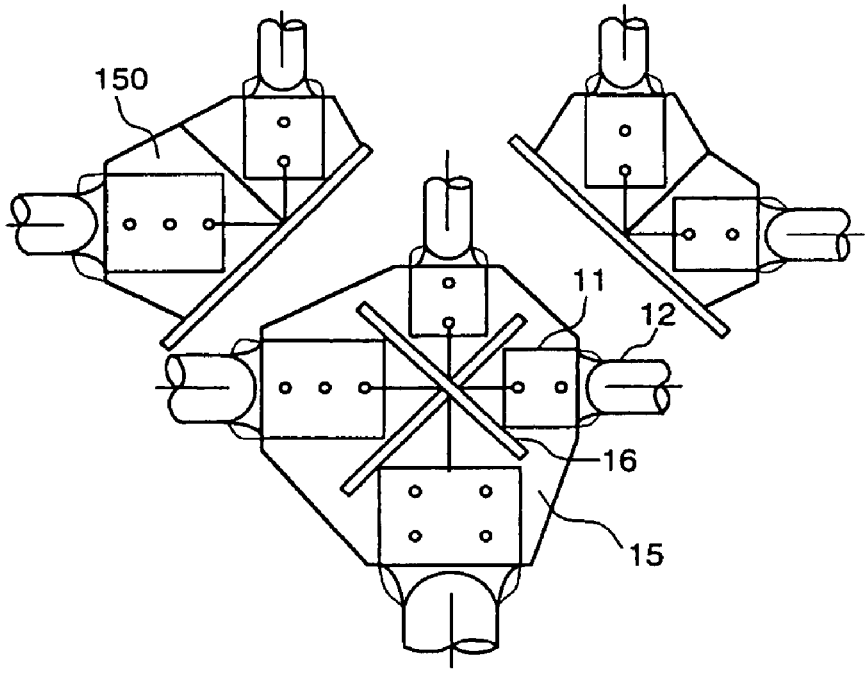
FIGS. 8 (*a*) and (*b*) show examples of joint structures using the embodiments of FIGS. 6 (*a*) and (*b*).
Figure 8:
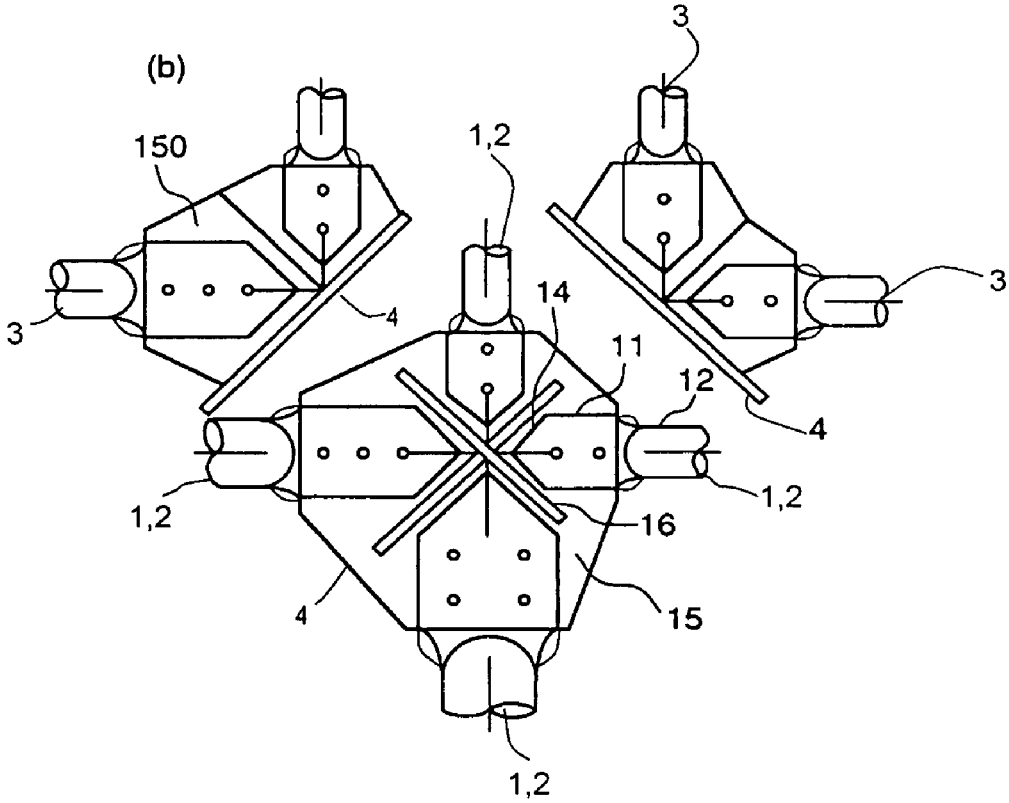

Examples of truss structures assembled using the embodiments of FIGS. 7 (*a*) and (*b*) are shown in FIG. 8. Numeral 150 depicts a plate for diagonal chord members. As clearly understood from the drawing, by provision of a tapered sword edge to the flattened plate section of the pipe, a distance from the center of joint to the center of the bolt can be shortened substantially. It is easily understood as well that the sizes of parent plates 15, 16 can be reduced. It should be noted here that by adoption of "1" which is shorter than "L", the mechanical stability and endurance of the joint can be increased substantially. Further, the cost of manufacture thereof can be reduced. In the embodiment of FIG. 6 (*b*), a relationship between "1" and "d" is defined to be $1/d \approx 4$; however, it is not limited thereto, and the following equations may be adopted depending on the types of bolts to be used.

Figure 6:
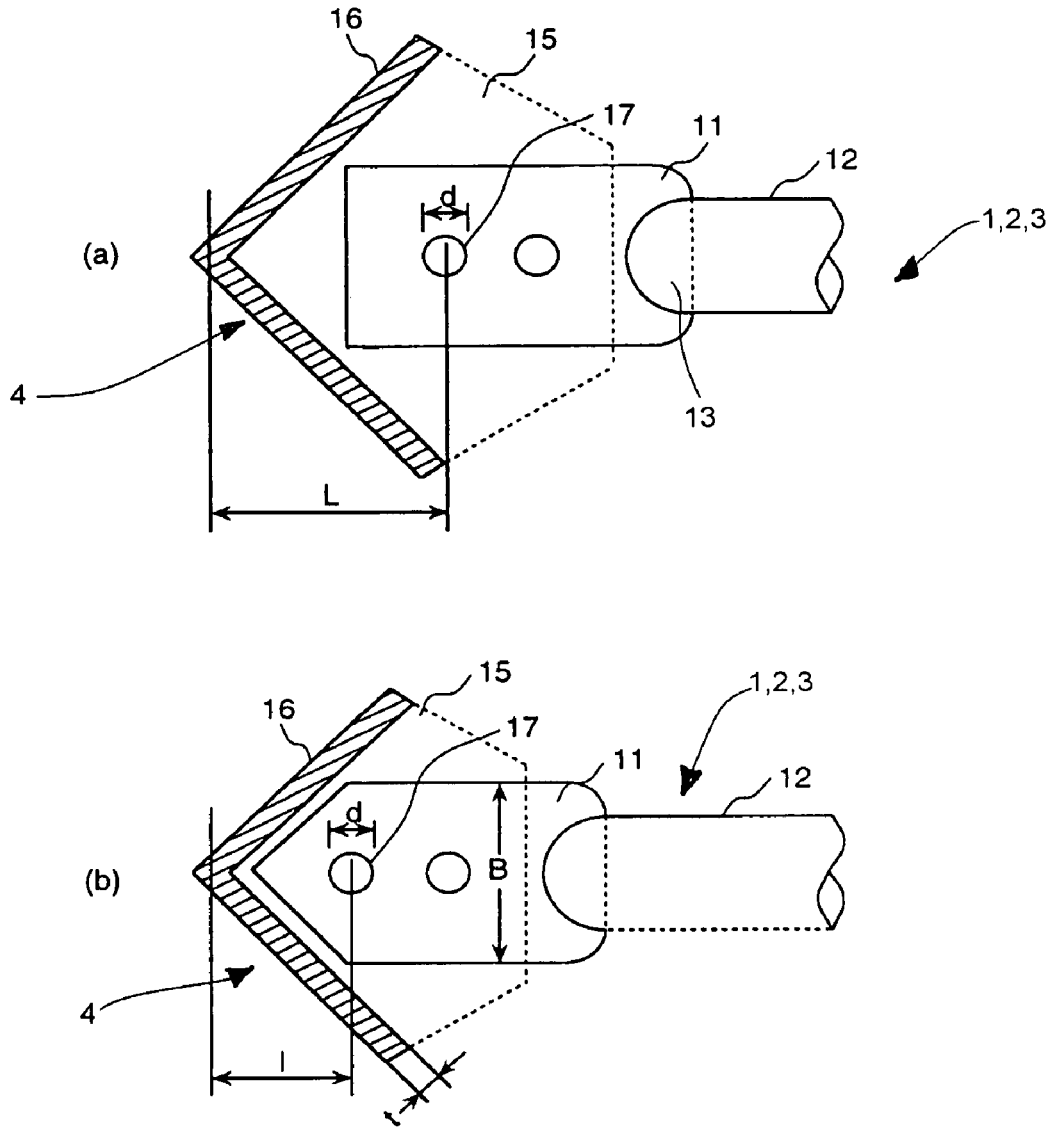
FIGS. 6 (*a*) and (*b*) show two different embodiments of the invention.

In the case of FIG. 6 (*b*):

$$l \leqq \sqrt{2}t/2+10\sqrt{2}+2.5\ \mathrm{d(mm)} \qquad \text{(eq. 1)}$$

In the case of FIGS. 7(*a*) and (*b*):

$$l \geqq \sqrt{2}t/2+10\sqrt{2}+2.0\ \mathrm{d}+B/2(\mathrm{mm}) \qquad \text{(eq. 2) and}$$

$$\mathrm{l}>3\ \mathrm{d} \qquad \text{(eq. 3).}$$

In the case of FIG. 6 (*a*):

$$\sqrt{2}t/2+10\sqrt{2}+2.5\ \mathrm{d(mm)}<L \geqq \sqrt{2}t/2+10\sqrt{2}+2.5\ \mathrm{d}+B/2\ (\mathrm{mm}) \qquad \text{(eq. 4).}$$

With the diameter of the bolt assumed to be "d", and the leading edge to be tapered, any length of "1" can be determined according to the above-mentioned equations. Therefore, the distance between two separate joints can be shortened substantially thereby improving the rigidity of the joints compared to those of the embodiment of FIG. 6 (*a*). Some examples according to the invention are shown in Table 1.

TABLE 1

| | EXAMPLES OF QUANTITIES (B = 63.4, in mm.) | | |
|---|---|---|---|
| d | FIG. 6(a) | FIGS. 7(a) & (b) | FIG. 6(a) |
| when t = 6: | | | |
| 12 | 48.4 | 74.1 | 80.1 |
| 16 | 58.4 | 82.1 | 90.1 |
| 20 | 68.4 | 90.1 | 100.1 |
| 22 | 73.4 | 94.1 | 105.1 |
| 24 | 78.4 | 98.1 | 110.1 |
| when t = 9: | | | |
| 12 | 50.5 | 76.2 | 82.2 |
| 16 | 60.5 | 84.2 | 92.2 |
| 20 | 70.5 | 92.2 | 102.2 |
| 22 | 75.5 | 96.2 | 107.2 |
| 24 | 80.5 | 100.2 | 112.2 |

Further, even in the examples of FIG. 6 (*a*) of the invention, because the plastic deformation portions inevitably present in the conventional products are eliminated, inter-distance between the joints can be shortened, thereby increasing the rigidity of the joints accordingly.

As described heretofore, because the pipe member serving as the chord member is provided with the constrained curved surface section and flattened tube section on both ends thereof which are formed by the constrained pattern shaping pressing in order to facilitate the connection and assembly thereof, the design limitation involved in the prior art resulting the size of the parent plates becoming inevitably large due to the existence of the free plastic deformation portion therein can be eliminated. Therefore, the size of the parent plates can be decreased substantially and the rigidity of the joints can be increased.

Further, by provision of the tapered leading edge to the flattened connection part of the chord members, the inter-joint distance can be reduced substantially, thereby increasing the rigidity of the joint.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A truss structure comprising an upper chord member, a lower chord member, a diagonal chord member connected to a parent plate, and a connection part formed on an end of each of said chord members, wherein said upper chord member, said lower chord member and said diagonal chord member each comprise a pipe member; and said connection part comprises a tubular section and a flat section formed integral and continuously with said tubular section extending from and integral with each said pipe member said flat section having a width determined by the diameter of the pipe member; wherein said connection part is connected to said parent plate via a bolt passing through a bolt opening formed in said flat section, and an edge portion of the tubular section defining a semi-circular boundary with said flat section and said flat section includes a transitional slack portion at both ends of the semi-circular boundary and said parent plate includes a rib erected crosswise thereon, and an edge of said flat section is tapered to allow for each flat section of each chord member to be positioned in close proximity to said parent plate.

2. A truss structure according to claim 1, wherein the size of the tapered edge of said flat section is determined by the following relationship:

$$\ell \leqq \sqrt{2}t/2+10\sqrt{2}+2.0\ \mathrm{d}+B/2, \text{ and } \ell>3\ \mathrm{d(mm)}$$

wherein l is a length between centers of the bolt opening of respective flat sections of opposed chord members on the parent plate, d is the diameter of bolt and B is the width of the respective flat sections.

3. A truss structure comprising an upper chord member, a lower chord member, a diagonal chord member connected to a parent plate, and a connection part formed on an end of each of said chord members, wherein said upper chord member, said lower chord member and said diagonal chord member each comprise a pipe member; and said connection part comprises a pipe tubular section having a curved surface which is formed integrally with and to extend from said pipe member from the pipe member being flattened into a single piece and a flat section formed integral with said pipe tubular section and having a width determined by the diameter of the pipe member; wherein said connection part is connected to said parent plate, via a bolt passing through a bolt opening formed in said flat section, and an edge portion of the pipe tubular section defines a semi-circular boundary with said flat section, said flat section including a transitional slack portion at both ends of the semi-circular boundary and said connection part further comprises said parent plate and a rib erected crosswise thereon, and wherein an edge of said flat section is configured to allow for each flat section of each chord member to be positioned in close proximity to said parent plate.

4. A truss structure according to claim 3, wherein the size of the tapered edge of said flat section is determined by the following relationship:

$$\ell \leqq \sqrt{2}t/2+10\sqrt{2}+2.0\ \mathrm{d+B/2}, \text{ and } \ell>3\ \mathrm{d(mm)}$$

wherein $\ell$ is a length between centers of the bolt opening of respective flat sections of opposed chord members on the parent plate, d is the diameter of bolt and B is the width of the respective flat sections.

* * * * *